US008286727B2

(12) United States Patent
Hickman

(10) Patent No.: US 8,286,727 B2
(45) Date of Patent: Oct. 16, 2012

(54) WEIGHING AND DISPLAY STATION

(76) Inventor: Don Darrell Hickman, Williston, ND (US)

( * ) Notice: Subject to any disclaimer, the term of this patent is extended or adjusted under 35 U.S.C. 154(b) by 0 days.

(21) Appl. No.: 12/797,445

(22) Filed: Jun. 9, 2010

(65) Prior Publication Data

US 2012/0103248 A1 May 3, 2012

Related U.S. Application Data

(63) Continuation of application No. 12/582,457, filed on Oct. 20, 2009, now abandoned.

(60) Provisional application No. 61/106,924, filed on Oct. 20, 2008.

(51) Int. Cl.
*E21B 19/08* (2006.01)

(52) U.S. Cl. ..... 175/27

(58) Field of Classification Search ..... 73/152.03, 73/152.43, 152.51–152.53, 296; 175/27, 175/40, 57; 166/250.01
See application file for complete search history.

(56) References Cited

U.S. PATENT DOCUMENTS

| | | | | |
|---|---|---|---|---|
| 2,969,968 | A * | 1/1961 | Miller | 177/161 |
| 6,176,323 | B1 * | 1/2001 | Weirich et al. | 175/40 |
| 6,206,108 | B1 * | 3/2001 | MacDonald et al. | 175/24 |
| 6,615,931 | B2 * | 9/2003 | Dycus et al. | 175/27 |
| 6,741,185 | B2 * | 5/2004 | Shi et al. | 340/853.2 |
| 7,044,239 | B2 * | 5/2006 | Pinckard et al. | 175/57 |
| 7,938,197 | B2 * | 5/2011 | Boone et al. | 175/27 |
| 2003/0127250 | A1 * | 7/2003 | Dycus et al. | 175/57 |
| 2004/0211595 | A1 * | 10/2004 | Pinckard et al. | 175/24 |
| 2008/0156531 | A1 * | 7/2008 | Boone et al. | 175/27 |
| 2009/0090555 | A1 * | 4/2009 | Boone et al. | 175/45 |

OTHER PUBLICATIONS

Deadline weight type indicator (admitted prior art), 2007.
Front and rear views of a pad type weight indicator (admitted prior art), 2007.

* cited by examiner

*Primary Examiner* — John Fitzgerald
(74) *Attorney, Agent, or Firm* — Merchant & Gould PC

(57) ABSTRACT

A system for monitoring loads at well drilling and service operations includes a digital user interface. The digital interface is in electronic communication with a first pressure transducer in fluid communication with a first pad type hydraulic load sensor, a second pressure transducer in fluid communication with a second pad type hydraulic load sensor, and a third pressure transducer in fluid communication with a hydraulic diaphragm type deadline load sensor. The digital user interface module functions to monitor the hydraulic pressures experienced at each pressure transducer and functions to calculate and display a corresponding weight load in numerical and graphical form for each pressure transducer. The digital user interface is also in electronic communication with a fourth transducer in fluid communication with a hydraulic power tong unit. The digital user interface module also functions to monitor the hydraulic pressure experienced at the pressure transducer and functions to calculate and display a corresponding torque load produced by the power tongs in numerical and graphical form.

7 Claims, 18 Drawing Sheets

WEIGHING AND DISPLAY STATION

TECHNICAL FIELD

This disclosure relates to weighing and display systems relevant to the drilling and well servicing industry. In particular, the disclosure relates to weighing and display systems for well drilling and service rigs which provide for temperature and load compensation, eliminate the need for multiple weight indicator systems, can be used in parallel with existing weight indicator systems and can collect data regarding the drilling and servicing processes.

BACKGROUND

Mobile service and drilling rigs have been commonplace for many years and are primarily used to drill boreholes and to perform various other downhole operations. In a great number of applications, the total weight of the shaft and the rigging equipment can far exceed the desirable weight at the drill head for optimal drilling and other operations. As shaft equipment extends deeper into a downhole, additional shaft or tubular sections must added to increase the length of the apparatus. As such a process continues, the gross weight of the shaft and rigging equipment increases and naturally exerts additional force on the drill head. In some applications, this weight may increase by an average of over six pounds for every vertical foot of shaft. If the total weight of the shaft and rigging equipment is continuously allowed to be placed on the shaft head, undesirable results may occur. For example, excessive weight on a drill bit during drilling can result in a bore hole which is not straight.

To eliminate problems due to excessive shaft weight, weight indicators have been developed and used since the early $20^{th}$ Century. By using a weight indicator, a rig operator can observe the relative weight of the drilling equipment that is being supported by the equipment rather than at the shaft head. Using this information, the operator can either increase or decrease the tension in the rigging to vary the net weight placed on the drill head. Because of their usefulness, weight indicators have become an essential tool for many downhole operations and have become ubiquitous in the downhole drilling and servicing industry.

There are generally two types of weight indicators which have become the most prevalent in the industry: the diaphragm type weight indicator and the pad type weight indicator. Both types use hydraulic fluid in a closed loop system in conjunction with analog bourdon tube type dial gages to indicate a change in pressure in the system. Each type also has changeable load dials having varying scales to correspond to different pad diameters or rigging systems which may be used in a given application. Another similarity is that both types of indicators require that the fluid pressure be manually dampened prior to engaging in certain operations which can lead to sharp changes in system pressure. This is required to protect the bourdon tube type gauges that are typically used for these indicators. Even though these and other similarities exist, the indicators are very different with respect to the location on the rig where the measurements are being taken and the type of sensing equipment utilized. A discussion of each type of weight indicator follows.

The diaphragm type weight indicator generally has a diaphragm unit, a gauge and a hose connecting the diaphragm unit to the gauge. This type of system is generally pre-filled with fluid and the fluid level is not readily changeable by the end user. In practice, the diaphragm unit is clamped onto the static deadline of a rig. When installed, the diaphragm forces a one inch deflection in the line. As the tension in the deadline increases from additional loads on the rigging, the deadline tends to straighten against the diaphragm. As this straightening force increases, the diaphragm is compressed thereby causing an increase in fluid pressure which is reflected at the gauge. The hook load, which is generally supported by a 2, 4 or 6 line tackle system, is directly proportional to the tension in the deadline. To accommodate the varying tackle arrangements and line numbers, differently scaled load dials are used to indicate an actual weight measurement. In general, the fluid pressure will range from 0 pounds per square inch at no load to 100 pounds per square inch at full load for this type of system.

The diaphragm weight indicator performs well at sensing differences in the hook load, but is generally not capable of providing a measurement for absolute hook load. Several factors contribute to this condition. First, because the hydraulic fluid is in a closed system, the pressure in the system is dependent on the fluid temperature. Thus, large ambient temperature changes will result in different readings for the same hook load. Second, the fluid level in the system is not easily checked or serviced by the user. Thus, it is not always known if the fluid levels are at the appropriate level. Third, excessive frictional forces in the rigging tackle system can cause readings to become distorted. Fourth, and lastly, the connection of the diaphragm to the deadline and the resulting contact points are not always consistent. This is especially true if system components become worn over time. Although all of these factors do present problems with determining an absolute load, the system does provide generally reliable information for changes in hook load. Further, only knowing load changes is generally sufficient for most service and drilling operations. As a result, the diaphragm type weight indicator has become very popular over a long period of time as a rugged and reliable tool for downhole operations.

The pad type weight indicator relies upon a very different method of operation and can be used to obtain an absolute weight value for the hook load. It should be noted that when a pad type indicator is being used, an operator would not also use a diaphragm type weight indicator at the same time. Rather, the operator would choose one type of indicator or another based on the particular application at hand. The pad type indicator relies upon two load cells, each of which is located under the service rig's jack screws or mast legs. The load cells are generally 6, 7 or 8 inches in diameter and are connected via hoses to individual bourdon type pressure indicating gauges and also to a pressure integrator or summarizer configured to add the two pressures together. The pressure integrator has a tube connected to a third gauge which indicates the total system weight. The fluid operating pressure in this type of system is typically ranges from 0 to 2,000 pounds per square inch (psi) and potentially up to 3,000 psi. Additionally, the load dials for this type of system are differently scaled based on the pad diameter and are generally able to rotate such that the load can be zeroed or tared. This feature allows the user to compensate for the weight of the mast itself, forces exerted by the guy wires stabilizing the mast and potential temperature effects on the closed system. Because the pads are directly under the mast legs, the indicated load is not skewed by frictional forces in the rigging system. There is not a concern with inaccuracies due to fluid level for this system because the user can readily monitor and ensure proper fluid levels. As such, the pad type weight indicator provides a reliable and rugged option to the diaphragm type indicator and is also capable of providing a good indication of absolute hook load.

Even though the diaphragm and pad type weight indicators have gained wide acceptance in the well service industry and are considered vital tools, improvements are possible and desired. This is especially true in light of the many technological advances that have recently occurred with respect to the electronics industry.

SUMMARY OF THE DISCLOSURE

One aspect of the invention constitutes an improvement in diaphragm type weight indicators for well drilling and service rigs. The improvement is a rotating load dial which can be rotated about a central pivot point to provide a taring function. No such rotatable dial exists to date for use in deadline type weight indicators for well drilling and service rigs. This rotatable load dial allows for the compensation of ambient temperature changes and the weight of the blocking system that supports the downhole equipment. The blocking system for some service rigs can be as much as 4,500 pounds. Although the resulting indication, after taring the rotating load dial, may still not be the absolute weight of the downhole equipment, a much closer value is obtained than currently possible. Further, the rotating load dial enables the user to more easily track changes in load because no subtraction is required, as is normally the case, once the dial is tared. Thus, a rotatable load dial for a diaphragm type weight indicator represents a considerable improvement over existing prior art indicators of this type.

Another aspect of the invention is a system for monitoring hook loads in well service and well drilling applications. This is accomplished through the use of pressure transducers that are in electronic communication with a digital user interface module and in fluid communication with a hydraulic diaphragm or hydraulic load cells. Additionally, the system is capable of monitoring, tracking and controlling the output torque of a power tong which is typically used for assembling and disassembling threaded oil field tubular goods such as sucker rods, tubing, casing, downhole tools and other equipment. The system is also capable of acting as a controller of brake systems by functioning as a safety override of manual braking operations when hoisting loads and performing other operations. Lastly, the digital user interface module is optionally mounted onto an interface box which houses the piping for the transducers, the wiring for the transducers and the 12 volt power supply for the user interface. The user interface and the interface box can be constructed such that the assembled unit is mobile and readily moved from one service or drilling rig to another. The following paragraphs provide a more detailed description of the system and the benefits it represents over the prior art.

In one embodiment, the system comprises four pressure transducers located in the interface box and configured to produce a 4-20 milliamp output signal to the user interface module based on the sensed fluid pressure. One of the transducers is designed for use with a diaphragm type pressure indicator diaphragm and can accept a 0-100 psi range in fluid pressure. Two of the transducers are designed for use with a pad type pressure indicator load cells and can accept a 0-3000 psi range in fluid pressure. The fourth pressure transducer is designed for use with a power tong and can accept a 0-3000 psi range in fluid pressure. As should be appreciated, the fact that these transducers are all in electronic communication with the user interface module enables the user interface module to simultaneously monitor multiple hydraulic systems. These functions have not been combined into a single user interface module of this type to date. This functionality is unique in the mobile downhole service and drilling industry and represents a significant advantage over the current practice of using individual devices for each activity.

Each pressure transducer is in fluid communication with a first quick connect coupling. The quick connect couplings allow for easy connection to hydraulic hoses which are in fluid communication with the diaphragm, load cells or power tong hydraulic system. Optionally, each pressure transducer is in fluid communication with a second quick connect coupling also in fluid communication with the first quick connect coupling. This feature enables the standard type of weight indicator to also be in fluid communication with the diaphragm or load cells or power tong pressure indicator through the use of additional hoses. As can be appreciated, the second quick connect couplings allow for the user interface module to be in simultaneous and parallel use with the traditional indicating equipment meaning that an operator would not have to forego their use in order to gain the advantages of the invention. As both pad type and diaphragm type indicators are in heavy use, it is anticipated that an operator would be potentially reluctant to replace his or her trusted analog system with an electronic device before seeing the electronic device function well in actual use. Because the invention does not require that any existing equipment be removed, this issue is resolved with the invention and represents a significant advancement over the art.

The user interface module, in electronic communication with the pressure transducers, is optionally mounted to the interface box. The user interface module comprises a housing, an LCD interface screen, multiple knobs and buttons, a dip switch station, a transducer input station, an LED alarm light, a speaker and a flash card memory module. The user interface module is generally powered by a 12 volt power source which can come from the vehicle itself. Also, the user interface module can be optionally constructed to operate in temperatures as low as −30 degrees Fahrenheit. Even though the user interface module is described and shown in conjunction with pressure transducers, it should be appreciated that the module can also be configured for use with other types of non-hydraulic load sensing devices such as strain gages. The user interface module is described in further detail in the following paragraphs.

The user interface module housing is typically constructed of a plastic suitable for use in a harsh environment such as oilfield operations. However, it should be appreciated that the housing can be constructed of many different materials and can be configured such that it has an explosion proof rating or be located in a housing having such a rating.

The user interface module LCD screen is configured to display multiple screen views based on the position of mode selector knob. The mode selector knob allows for a user to choose among a deadline screen view, a pad type screen view and a torque screen view. Each of these views corresponds to a specific transducer input(s) based on the type of measuring equipment currently being used. The screen views are described in further detail later in the description.

The alarm level knob allows the operator to set an alarm limit in each of the screen views. The selected alarm level in each view is shown graphically and numerically. When the alarm threshold is exceeded, the user interface module is configured with an alarm speaker and an LED alarm light to notify the user that an alarm condition has been reached. Such a feature is not present in current diaphragm and pad type weight indicators and can greatly enhance the safety of drilling and servicing operations.

A tare button on the user interface module allows an operator to zero out the indicated load on the system. This feature replaces the rotating load dials of the pad type weight indicators and further enables the user to tare a deadline load even when using a diaphragm type unit. The latter function is not a feature present on prior art diaphragm type weight indicators.

A data logging button is also present on the user interface module. Through the use of a flash card module, measured and calculated data based on the pressure transducer inputs can be logged, stored and extracted. The module can be optionally configured to store seven days worth of measured load data. This information can provide the operator with very useful information regarding the downhole operations and the use of the servicing and drilling equipment. As typical weight indicators are purely analog devices, historical, digitized data from the described user interface module has not been available to date.

A dip switch station is also available on the user interface module allowing for software configuration of different types of pressure transducers and measuring devices which may be interfaced with the module. Because there are a number of different types of rigging configurations and load cell diameters, the user interface software is especially valuable in that multiple configurations can be stored and selected for a particular application. Currently, pad type and diaphragm type weight indicators use a multitude of load dials scaled for a particular application. The software configurations in the user interface module are capable of replicating each of these scales in a digital environment thereby eliminating the traditional step of acquiring, selecting and installing the appropriate load dial. Further, the user interface module is also capable of having software configurations created and/or uploaded such that any new devices can be integrated for use in the future. This will allow for the invention to be used with any manufacture of load cells, diaphragm units and other types of hydraulic or electronic load sensors. Lastly, it should be appreciated that the user interface module can be adapted such that different configurations can be created through the use of screen views and without the use of dip switches.

The user interface module also has a torque level knob which is used to view the torque screen view. This allows for the user to select the range of torque load that is displayed on the screen view. For example, during low load conditions, the user may wish to view a smaller range in order to see the graphical load displayed more clearly. Conversely, in high torque load conditions, the user may wish to display the entire range of loads. This feature is also available with all the other views as well such that the operator is always able to increase or decrease the graphical scale to obtain the best view possible of the load. Additionally, the software allows for the user, in all of the aforementioned situations, to increase or decrease the sensitivity of the measurement such that a more or less stable output reading and graph is displayed. These features represent a significant advancement over existing analog based weight indicators in that the load dials cannot be changed in such a manner and that the sensitivity adjustment is a manual operation. As might also be appreciated, the analog weight indicators must also be dampened during certain operations to prevent the gauge from being harmed from sharp spikes in fluid pressure. With the digital user interface, this is not a concern as bourdon tube type gauges are not present. As such, the invention not only eliminates the usual steps of manually dampening and undampening the gauge, it also is more reliable because the operator cannot accidentally harm the system by forgetting to dampen the system as is the case with the analog gauges.

When the user interface module mode selector knob is rotated to "deadline," the deadline screen view is displayed on the LCD screen. The deadline screen view shows the calculated present load based on the fluid pressure sensed at a corresponding pressure transducer. This pressure is induced by a diaphragm unit typically used in conjunction with a diaphragm weight indicator. The load value is shown both numerically and in the form of a bar graph. In addition to the load information, an alarm limit set point can be adjusted via the alarm knob and displayed numerically and on the bar graph. The bar graph can be configured to be color coded to represent whether the calculated load is below or above the selected alarm limit set point. The deadline screen view can also display trend log data of the calculated load at various intervals. For example, the trend log can show the calculated load at 1 second intervals for the past 30 seconds.

When the user interface module mode selector knob is rotated to "pad type," the pad type screen view is displayed on the display screen. This screen displays the individual and combined loads of load cells of the kind usually used with a pad type weight indicator. For one option, the pad type screen shows the individual calculated present loads for two load cells in graphical and numerical forms. The combined total load is displayed as well in graphical and numerical forms. As with the deadline view, the alarm features are the same with respect to the total calculated load. For the individually measured loads, the alarm limit value can be divided in half and displayed in the same fashion on each bar graph. Additionally, the bar graph can be color coded to show when the individual calculated loads are within 90% of the limit set point. Under a second option, the two load cell values are shown on the same bar graph which graphically shows the difference in load between the two load cells. When the loads are equal, a horizontal bar graph would show no value. However, as the loads become imbalanced, a bar appears on the more heavily loaded side of the graph and represents the disparity between the loads. This information is important to ensure that the drilling or servicing operation remains safe and that no dangerous conditions develop due to load imbalances. Graphically representing the load imbalance in this way provides an operator with easily recognizable information tied to an alarm that it typically only obtained by manually subtracting the reading on two analog gauges in a pad type weight indicator. As such, this type of display represents an improvement over such prior art devices.

When the user interface module mode selector knob is rotated to "torque," the pad type screen view is displayed on the display screen. In one embodiment, the torque from a power tong can be shown graphically on a bar graph and in numerical form. In addition to the load information, the alarm limit is also displayed numerically and on the bar graph. The bar graph is configured to be color coded to represent whether the calculated load is below or above the selected alarm limit set point. Optionally, the bar graph maximum value can be adjusted by the torque level knob thereby enabling the user to view a given value at different resolutions.

With all of the above described display screens, it should be appreciated that many different configurations are possible which integrate the various described features of the user interface module. This includes, but is not limited to: the ability to display, store and extract trend log data; the enabling and adjustment of visual and audible alarms; adjustment features which allow changes to the resolution of the graphs; color coding of graphs with respect to alarm set points and calculated load; and the creation and use of software configurations for different models and types of diaphragms, load cells and power tongs.

With respect to the invention, it should also be appreciated that the screen views can be modified to display information which may be present on the other screens. For example, the deadline screen view can be configured to display the numerical value of the power tong torque load. Further, additional screen views can be created which show different combinations of data other than that described above.

A variety of advantages of the invention will be set forth in part in the following description, and in part will be apparent from the description, or may be learned by practicing the invention. It is to be understood that both the foregoing general description and the following detailed description are exemplary and explanatory only and are not restrictive of the invention as claimed.

DETAILED DESCRIPTION

Reference will now be made in detail to exemplary aspects of the present invention that are illustrated in the accompanying drawings. Wherever possible, the same reference numbers will be used throughout the drawings to refer to the same or like parts.

Figure 1:
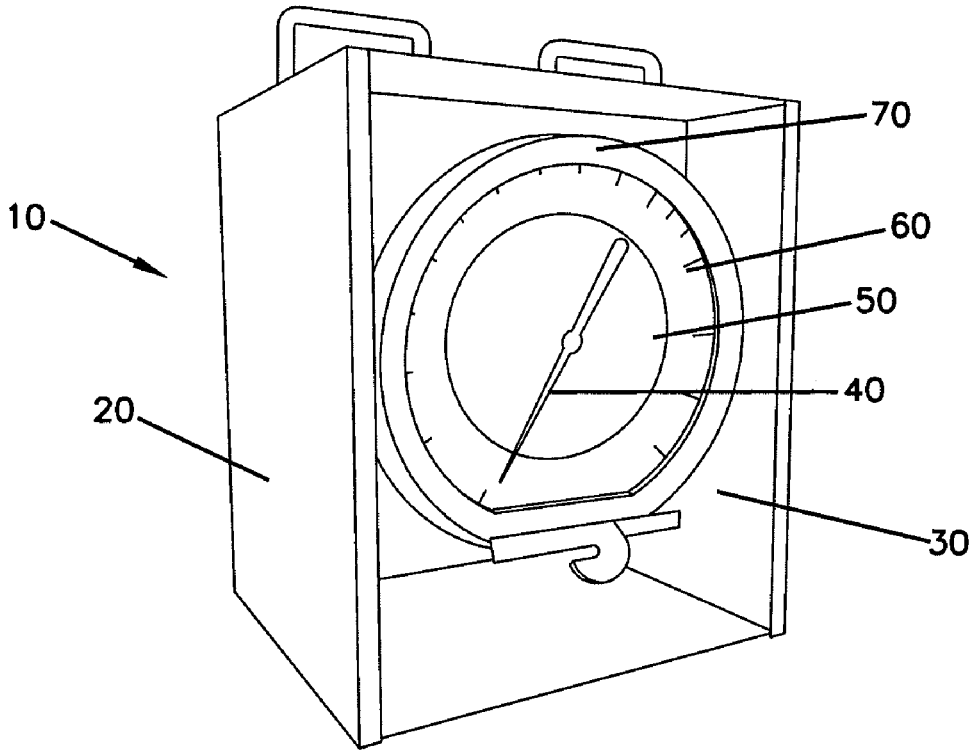
FIG. 1 (PRIOR ART)
FIG. 1 shows a front view of an exemplary deadline type weight indicator.

As shown in FIG. 1, an exemplary deadline weight indicator 10 used in the drilling industry includes a housing 20, a main gauge 30 having a main gauge body 70, an indicator needle 40 and a load dial 50 having a number scale 60. As can be seen, the load dial 50 is not able to be rotated to zero or tare the load because of the shape of the gauge and load dial. The indicator needle 40 represents the equivalent load based on the change in fluid pressure caused by a diaphragm unit (not shown) which is connected to a deadline (not shown).

Figure 2:
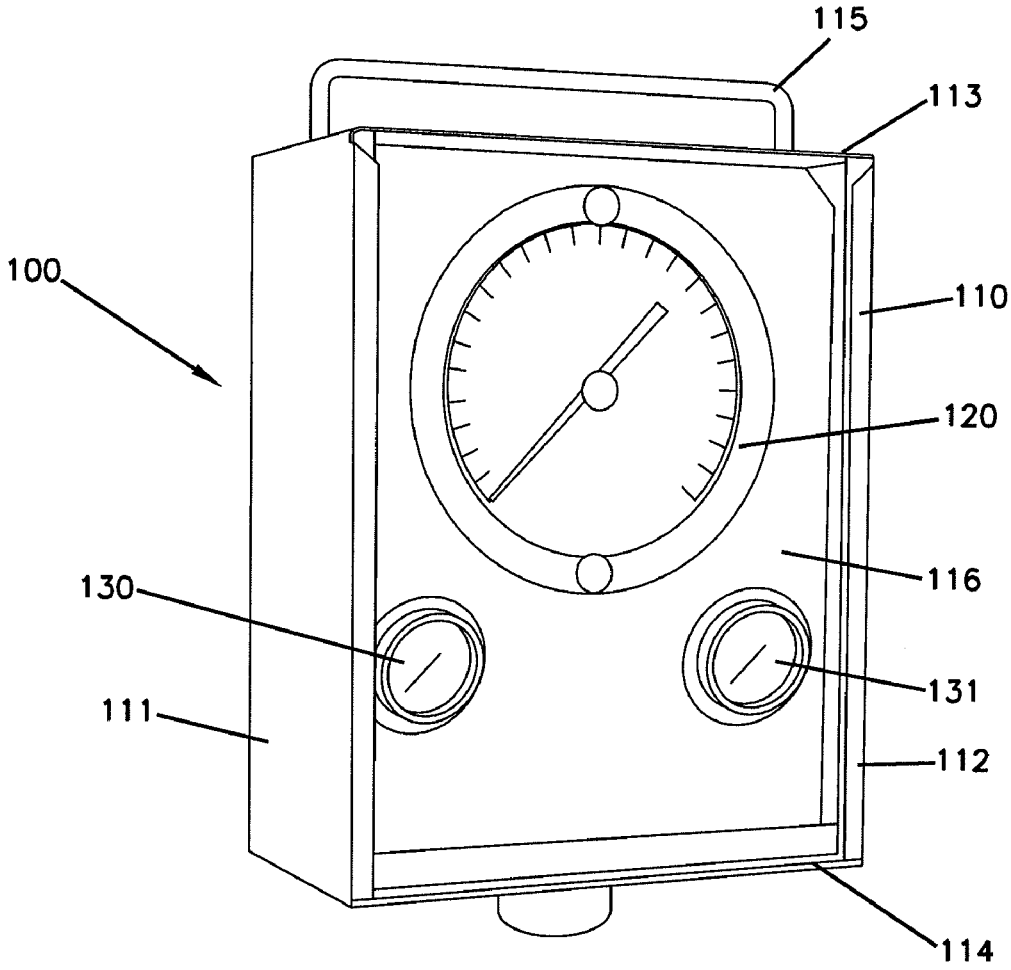
FIG. 2 (PRIOR ART)
FIG. 2 shows a front view of an exemplary pad type weight indicator.
Figure 3:
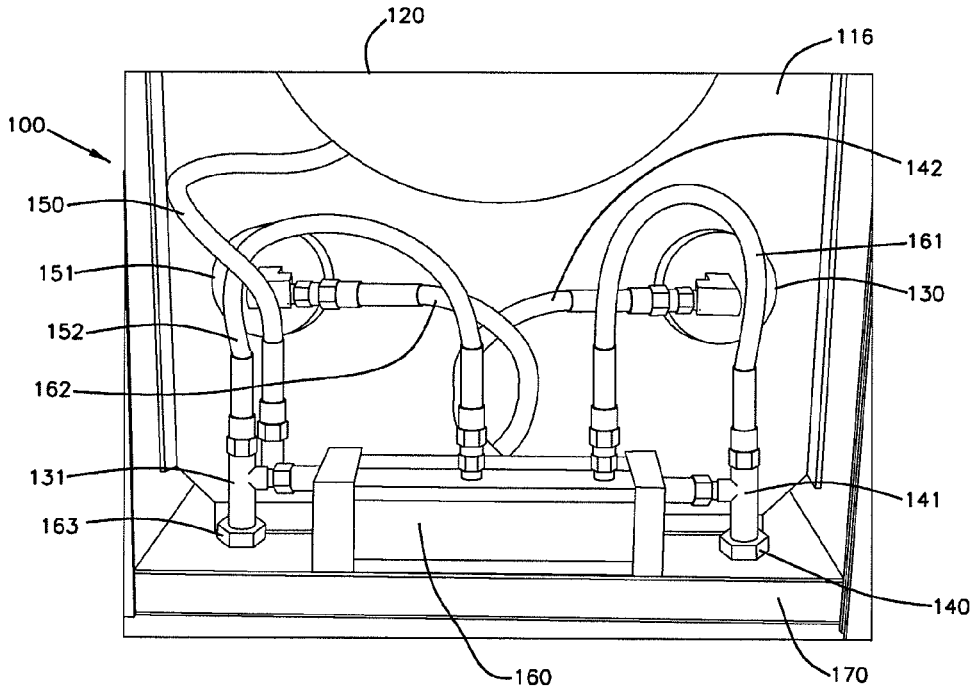
FIG. 3 (PRIOR ART)
FIG. 3 shows a rear view of an exemplary pad type weight indicator.

As shown in FIGS. 2 and 3, an exemplary pad type weight indicator 100 for the drilling industry is shown. The pad type indicator 100 comprises a housing 110 which has a first side 111, a second side 112, a top 113, a bottom 114, a handle 115 and a mounting panel 116. On the mounting panel 116, a main gauge 120, a first pad gauge 130 and a second pad gauge 131 are mounted. The first pad gauge 130 shows the equivalent load based on fluid pressure changes caused by the first pad (not shown). The second pad gauge 131 shows the equivalent load based on fluid pressure changes caused by the second pad (not shown). The main gauge 120 shows the sum of the loads displayed on the first pad gauge 130 and the second pad gauge 131.

On FIG. 2 the rear side of the pad type indicator 100 and the associated hydraulic components are shown. The first pad hydraulic hose (not shown) is connected to the first inlet line coupling 140 which is also connected to a first tee connection 141. From the first tee connection 141, a first pad gauge inlet line 142 is connected to the first pad gauge 130. The second pad hydraulic hose (not shown) is connected to the second inlet line coupling 140 which is also connected to a second tee connection 151. From the second tee connection 151, a second pad gauge inlet line 152 is connected to the second pad gauge 131.

The pad type indicator 100 also has a pressure integrator 160 which functions to add the pressures indicated at the first pad gauge 130 and the second pad gauge 131. From the first tee connection 141, a first inlet line 161 is connected to the integrator 160. From the second tee connection 151, a second inlet line 162 is connected to the integrator 160. From the pressure integrator 160, an outlet line 163 is routed to the main gauge 120.

Figure 4:
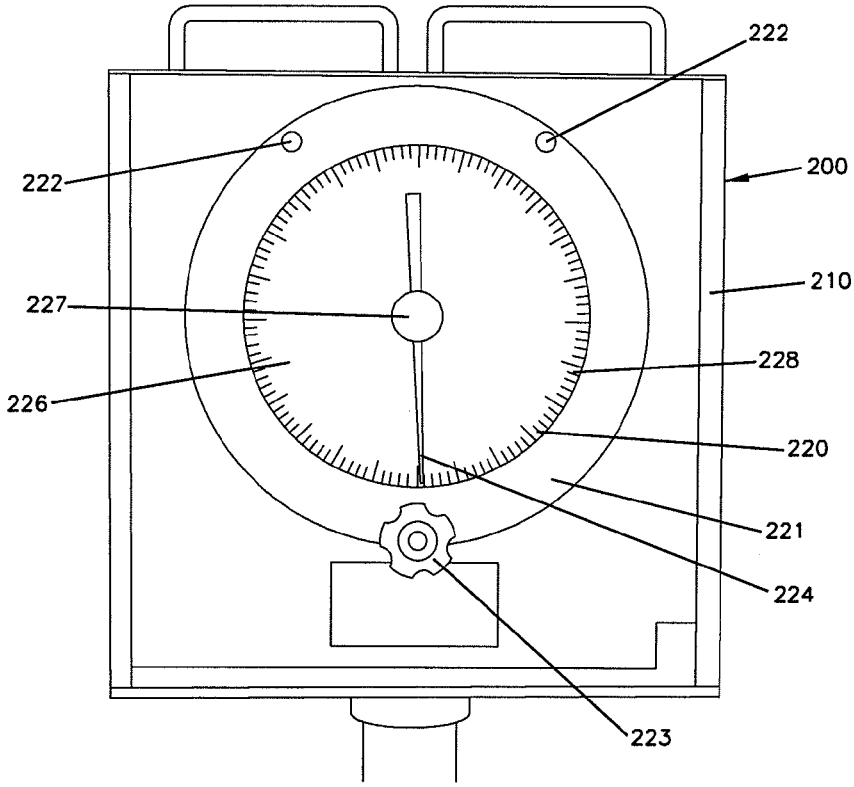
FIG. 4 shows a front view of a deadline type weight indicator configured with a rotating load dial.
Figure 5:
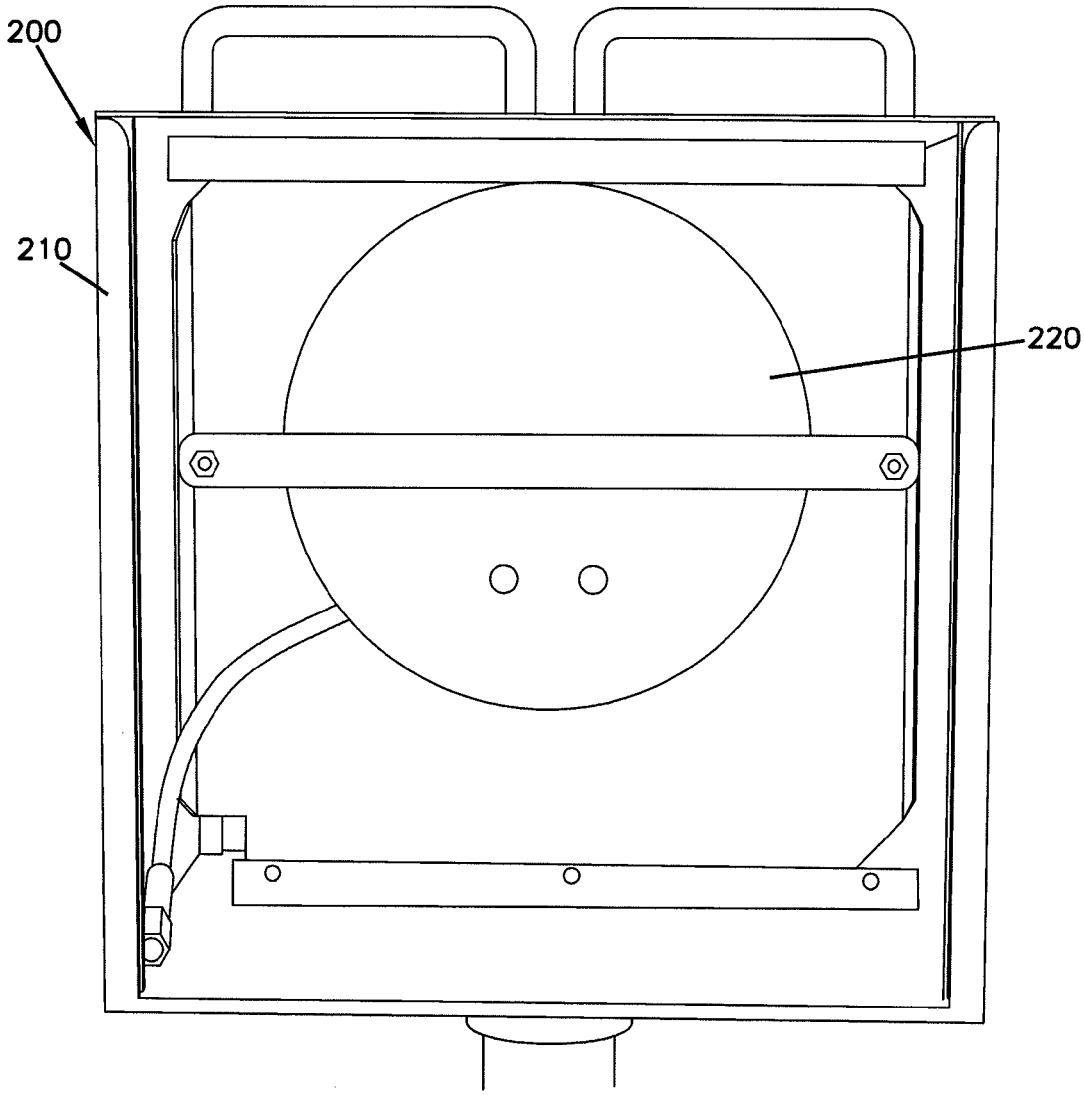
FIG. 5 shows a back view of the weight indicator of FIG. 4.

As shown in FIGS. 4 and 5, a new diaphragm type weight indicator 200 is shown having a housing 210 and a main gauge 220. The main gauge 220 is fitted with a rotating load dial 226 which has a rotation knob 227 for rotating the load dial 226. The rotating load dial 226 also has a numbered scale 228. The load dial 226 is secured to the main gauge 220 by a retaining ring 221. The retaining ring 221 is secured to the housing 210 by set screws 222 located near the top of the retaining ring 221 and a first knob 223 located at the bottom of the retaining ring 221. To lock the load dial 226 from rotating, the first knob 223 is tightened fully. To allow the load dial 226 to be rotated manually by the rotation knob 227, the first knob 223 is manually loosened. To remove the load dial 226, the first knob 223 and the set screws 222 are removed which allows the retaining ring 221 to be removed as well. Also shown in FIG. 2 is the main gauge needle 224 which indicates the load based on the pressure sensed from the diaphragm 300. The rotating load dial 226 allows the operator to zero out or tare the existing load on the system and to compensate for any changes in temperature. This is a function not present on existing deadline type weight indicators and represents and advancement over the prior art. FIG. 5 shows the back side of the diaphragm type weight indicator 200.

Figure 6:
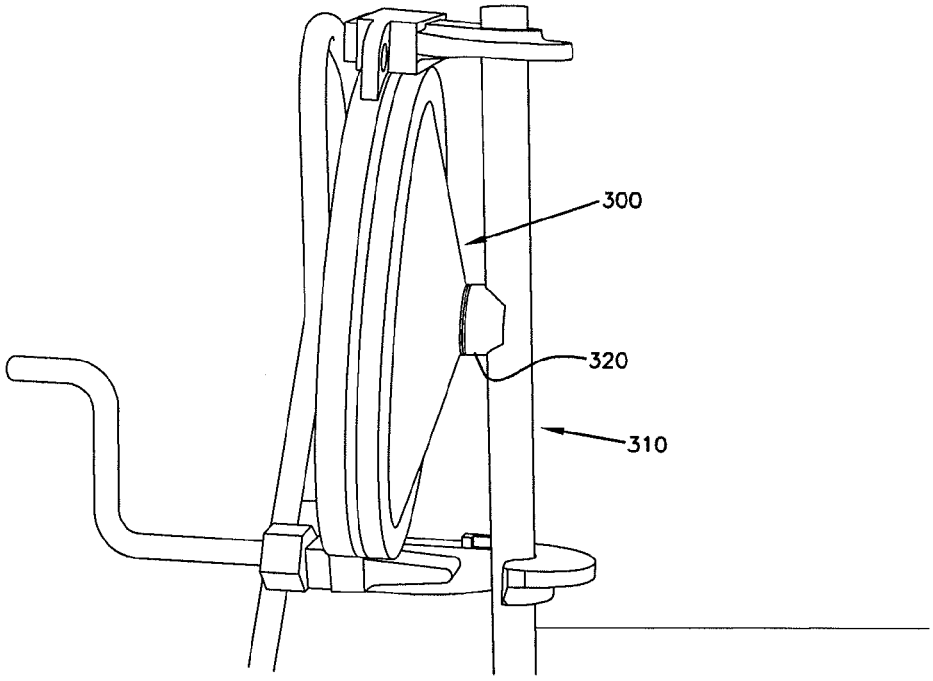
FIG. 6 shows a typical diaphragm unit used in conjunction with a deadline weight indicator.
Figure 7:
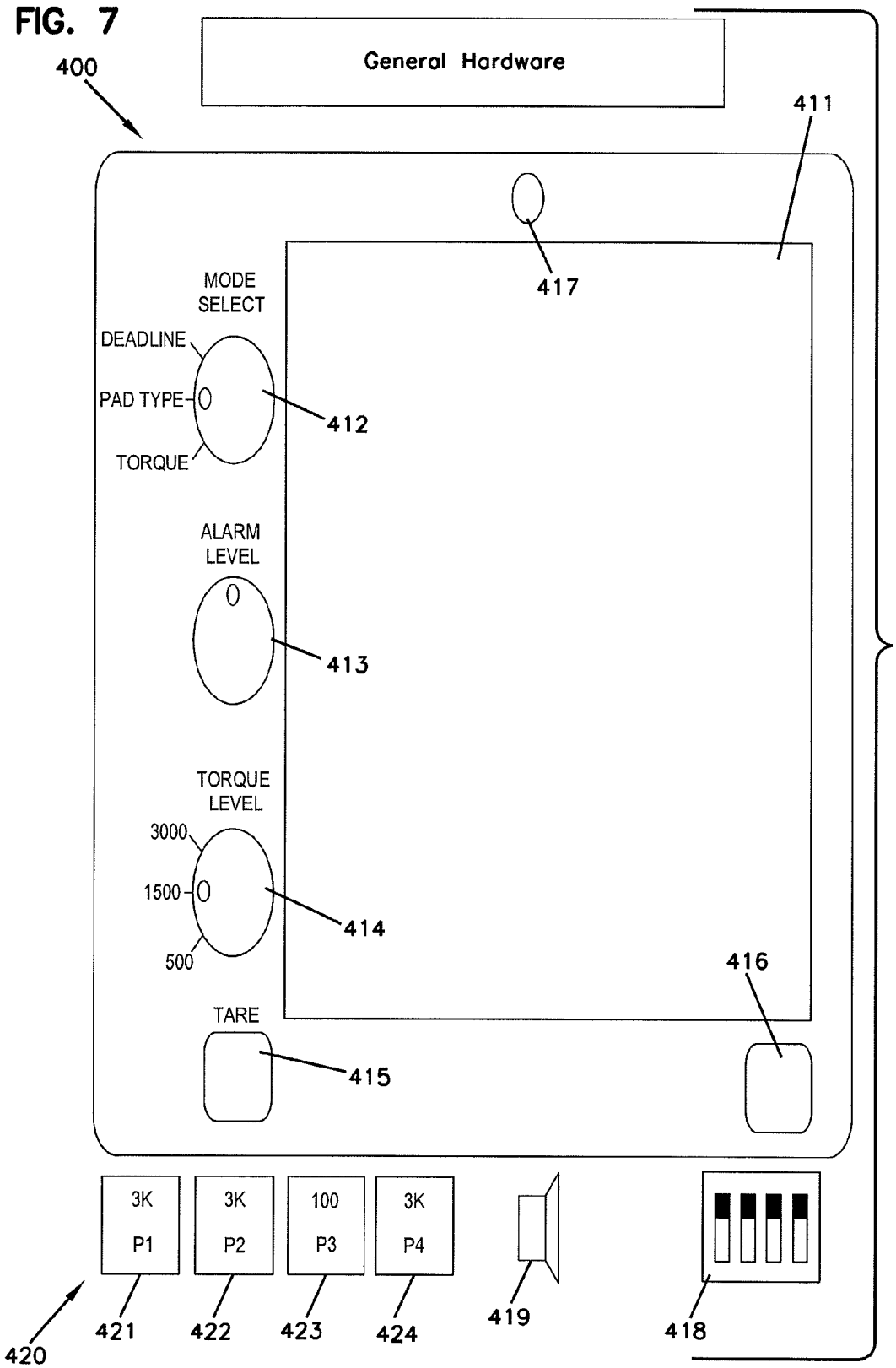
FIG. 7 shows a front view of the user interface module

On FIG. 6, a diaphragm unit 300 is shown clamped onto a support bar 310. Normally, the diaphragm unit would be clamped onto a deadline (not shown) instead of the support bar 310. The diaphragm unit 300 has a deflection plug 320 which imparts a deflection on the deadline when the diaphragm unit 300 is installed. As the deadline tension increases, it imparts a force against a diaphragm within the unit 300. The diaphragm inside the unit 320 is in hydraulic fluid communication with the main gauge 220 of the weight indicator.

FIGS. 7 through 18 show various embodiments and views of a digital user interface module 400 and its associated functions and components. As shown on FIG. 7, the user interface module 400 has an interface housing 410, an interface display screen 411, a mode selector knob 412, an alarm level knob 413, a torque level knob 414, a tare button 415, a data logging button 416, an LED alarm light 417, a dip switch station 418 and a speaker 419. Additionally, the user interface module 400 has an input station 420 with a first pressure transducer input 421, a second pressure transducer input 422, a third pressure transducer 423 and a fourth pressure transducer 424. Not shown are four pressure transducers which are mounted to either the housing 410 or a separate housing and are in electrical communication with the individual transducer inputs.

Figure 8:
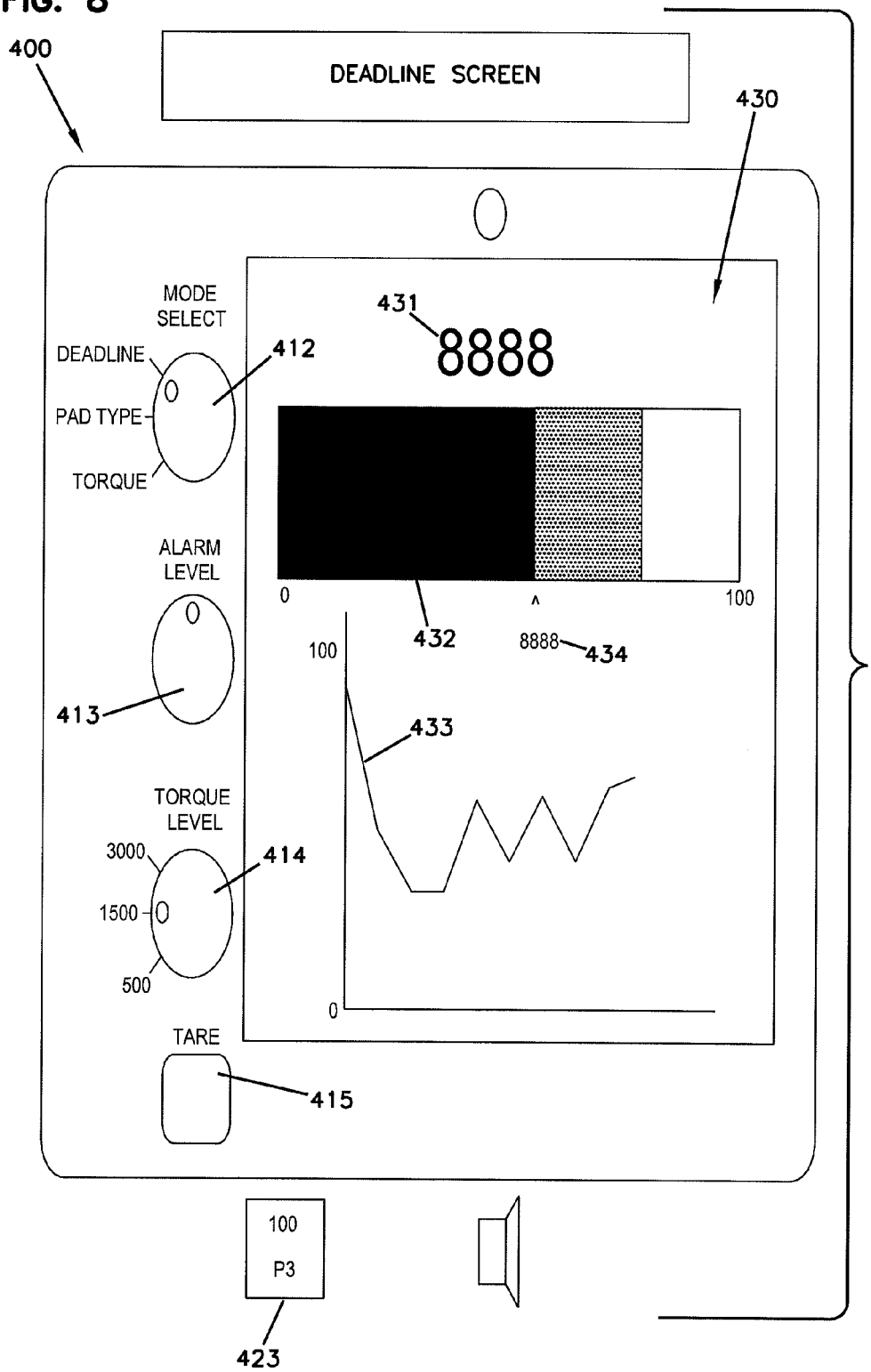
FIG. 8 shows the user interface model with the mode selector knob in the "deadline" position and showing the deadline screen view.

FIG. 8 shows the user interface module 400 with the mode selector knob 412 in the "deadline" position and displaying the deadline screen view 430 on the interface display screen 411. Deadline screen view 430 shows a numerical value 431 for the third pressure transducer input 423 in addition to a bar graph 432. The third pressure transducer input is a 4-20 milliamp signal derived from a 0-100 psi hydraulic pressure change. With this screen view, a diaphragm unit normally used in conjunction with a deadline type weight indicator is in fluid communication with the transducer. Also displayed is a trend log graph 433 which shows a graph of historical load data. The bar graph 432 can be color coded to represent whether the load has exceeded an alarm set point as defined by the alarm level knob. The bar graph also shows the alarm set point numerically. The user interface module 400 is configurable such that the LED alarm light 417 and the speaker 419 are activated if the load exceeds the alarm set point 434. The tare button 415 can be pressed at any point during the operation to zero out the current load value reading.

Figure 9:
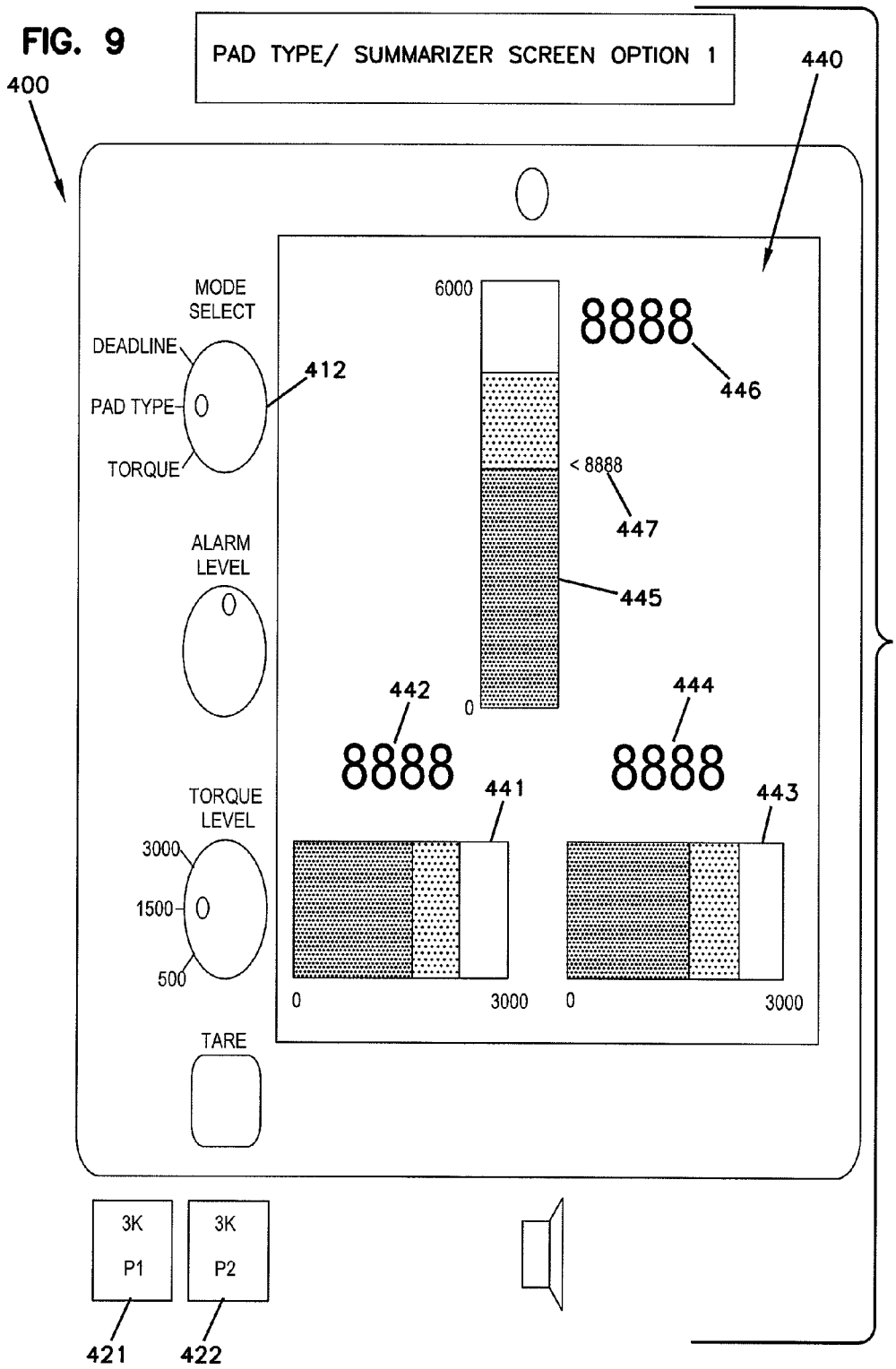
FIG. 9 shows the user interface model with the mode selector knob in the "pad type" position and showing a first option for the pad type screen view.

FIG. 9 shows the user interface module 400 with the mode selector knob 412 in the "pad type" position and displaying a first option screen view 440 on the interface display screen 411. This screen displays the individual and combined loads of load cells that are usually used with a pad type weight indicator. The first pad load cell is in fluid communication with the first pressure transducer which is in electrical communication with the user interface module via the input station 420. The second pad load cell is in fluid communication with the second pressure transducer which is also in electrical communication with the user interface module via the input station 420. Based on the load cell pressures, the interface module 400 calculates and displays a load for each load cell pad. The calculated load value for the first load cell pad is based upon the first pressure transducer input 421 and displayed in a first bar chart 441 and as a first numerical value 442. The calculated load value for the second load cell pad is based upon the second pressure transducer input 422 and displayed in a second bar chart 443 and as a second numerical value 444. The total calculated load based on the first and second transducer inputs is displayed as a third bar chart 445 and as a third numerical value 446. An alarm set point numerical value 447 is also displayed along the third bar chart 445. Additionally, an alarm condition is calculated for the first and second transducer loads by dividing the set point in half. As with the deadline screen view, this view also allows for the color coding of the bar charts such that the user can easily tell if any of the parameters are in an alarm condition.

Figure 10:
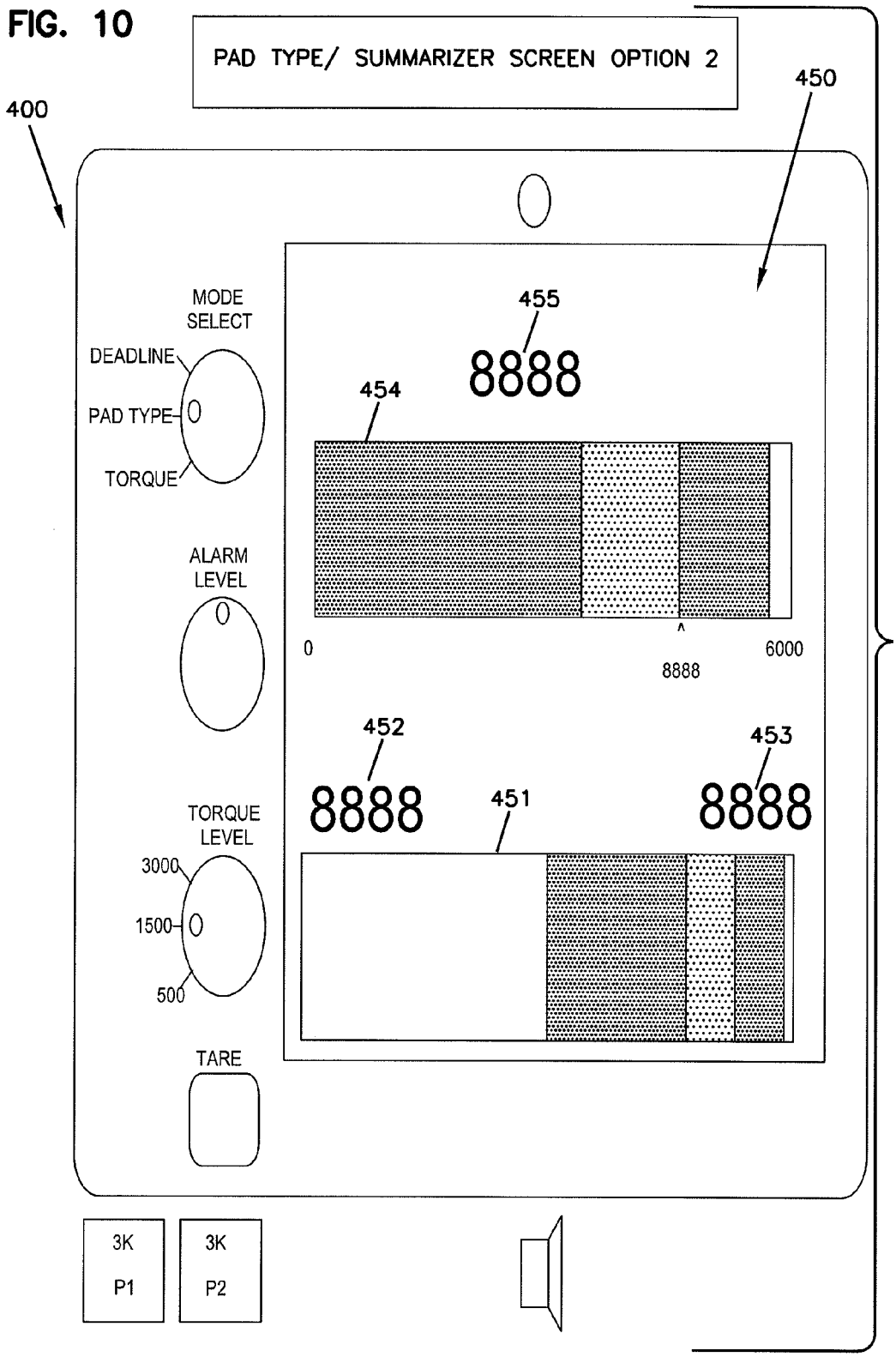
FIG. 10 shows the user interface model with the mode selector knob in the "pad type" position and showing a second option for the pad type screen view.

FIG. 10 shows the user interface module 400 with the mode selector knob 412 in the "pad type" position and displaying a second option screen view 450 on the interface display screen 411. This screen is based upon all of the same inputs and calculations which are performed on the screen shown in FIG. 9. However, the individual load cell information is shown in a much different manner in a combined bar chart 451 and with a first load cell numerical value 452 and a second load cell numerical value 453. In this screen view, bar chart 451 graphically shows the difference in load between the two load cells instead of the load value for each load cell. When the loads are equal, a horizontal bar graph would show no value. However, as the loads become disparate, a bar appears on the more heavily loaded side of the graph and represents the disparity between the loads. This screen also shows a color coding option wherein a separate color is provided when the loads are within 90% of the alarm limit set point.

Figure 11:
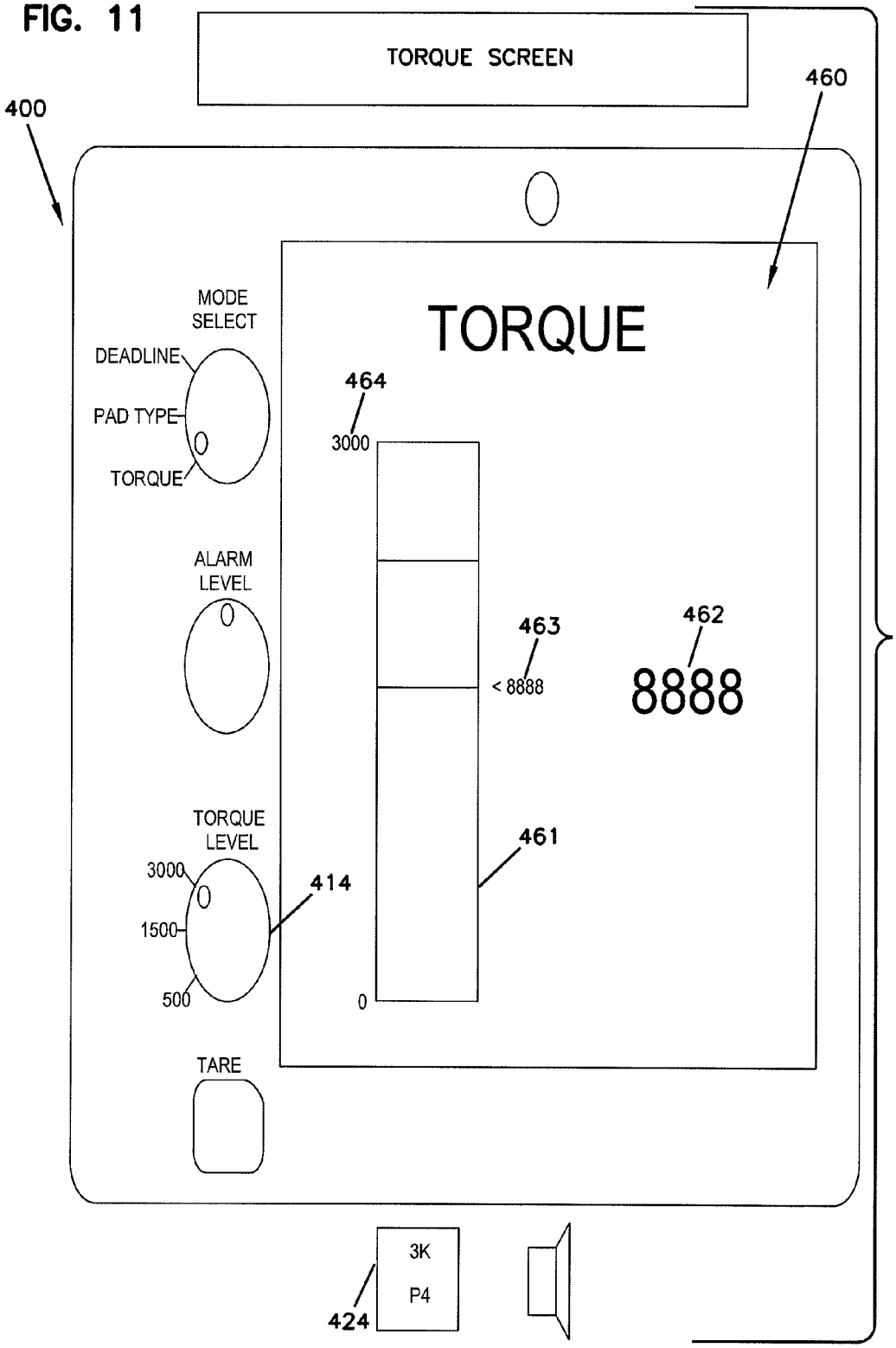
FIG. 11 shows the user interface model with the mode selector knob in the "torque" position and showing the torque screen view.

FIG. 11 shows the user interface module 400 with the mode selector knob 412 in the "torque" position and displaying the torque screen view 460 on the interface display screen 411. In one embodiment, the torque from a power tong can be shown graphically on a bar graph 461 and in numerical form 462. This data is based upon the fourth pressure transducer input 424 which is in electrical communication with a fourth pressure transducer which is in fluid communication with the hydraulic pressure in a power tong. The bar chart 461 is configured to be color coded to represent whether the calculated load is below or above the selected alarm limit set point. Additionally, the bar chart 461 maximum value 464 can be adjusted by the torque level knob 414 which enables the user to view a given value at different resolutions.

Figure 12:
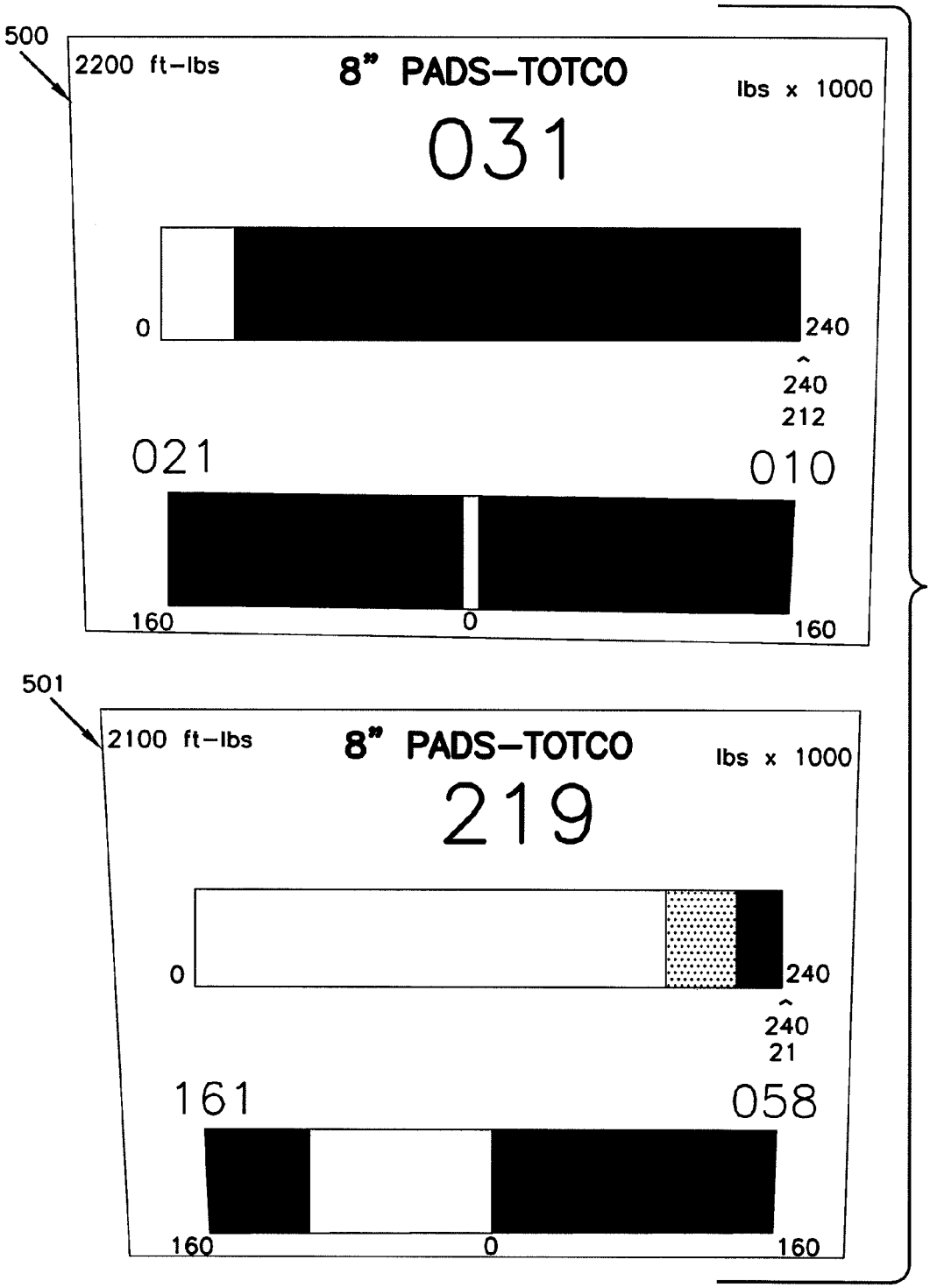
FIGS. 12-13 show optional screen views for displaying information for pad type load cells and a power tong torque output in various states of operation.
Figure 13:
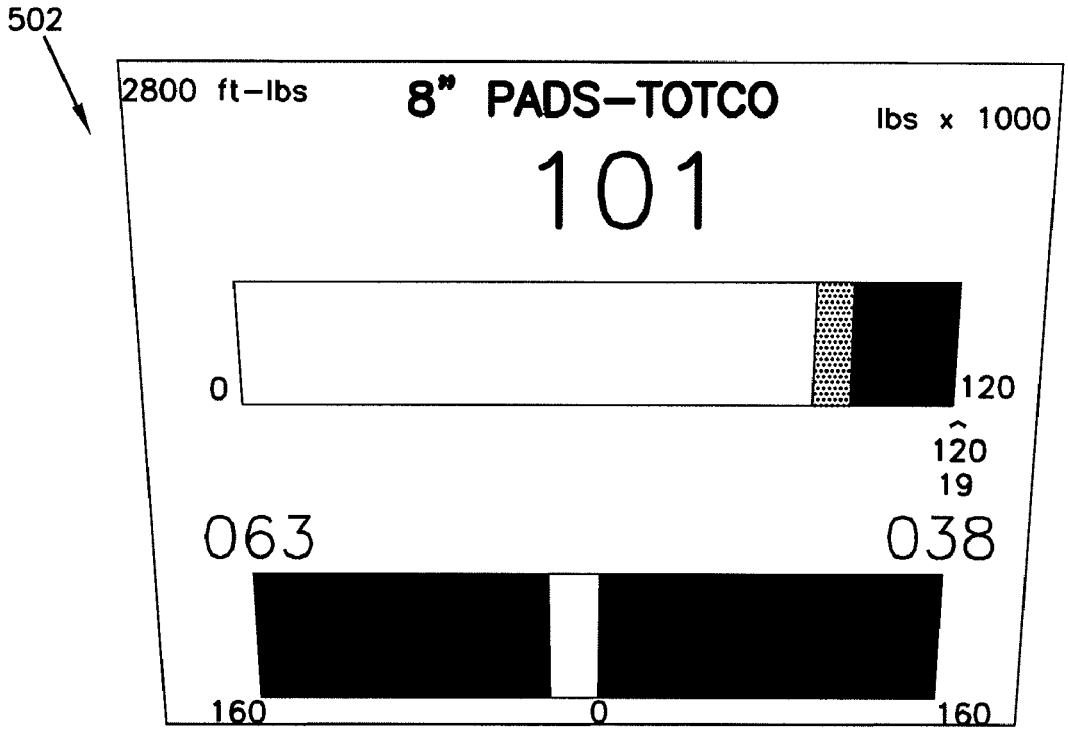
Figure 14:
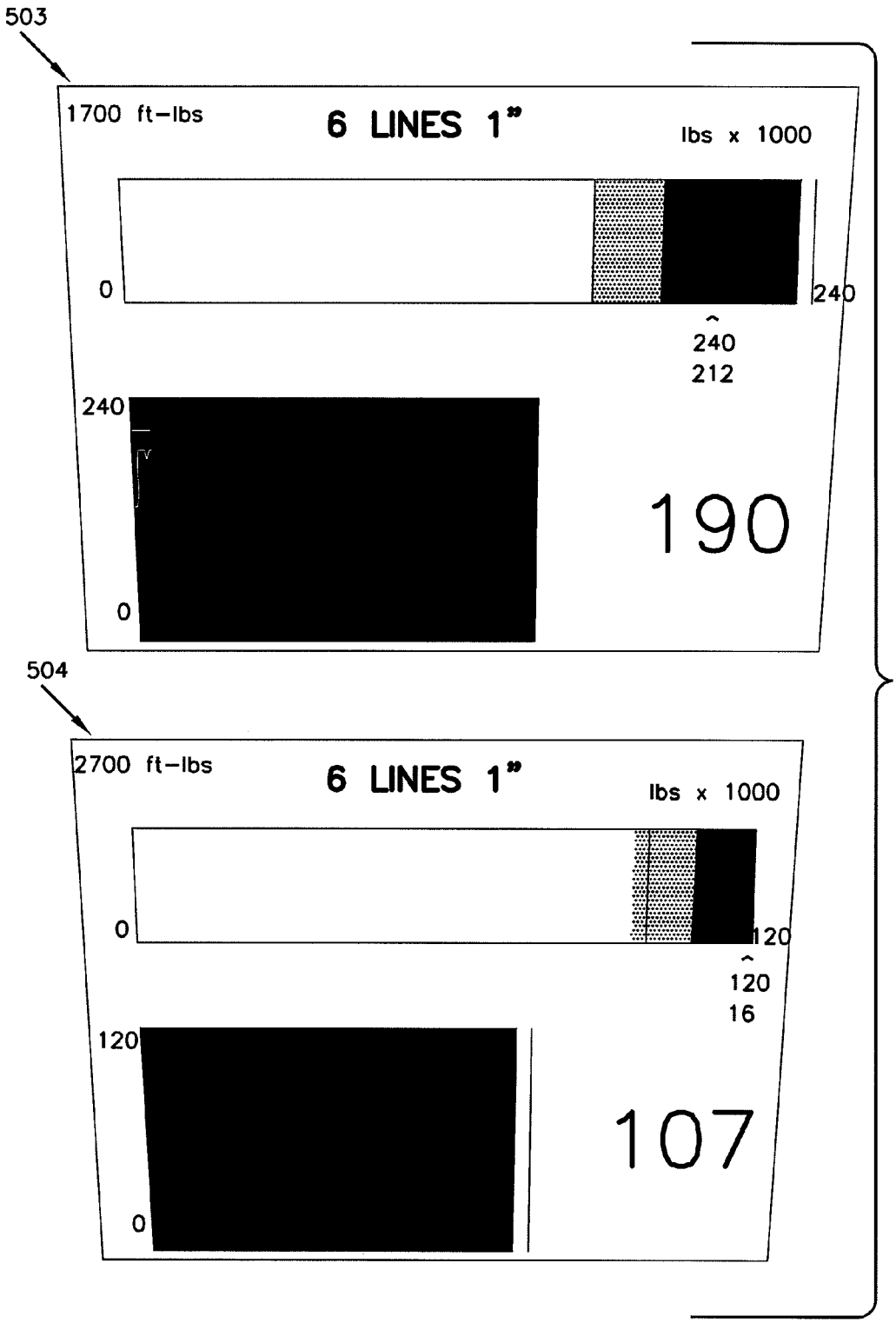
FIG. 14 shows optional screen views for displaying information for a diaphragm used on a deadline and a power tong torque output in various states of operation.
Figure 15:
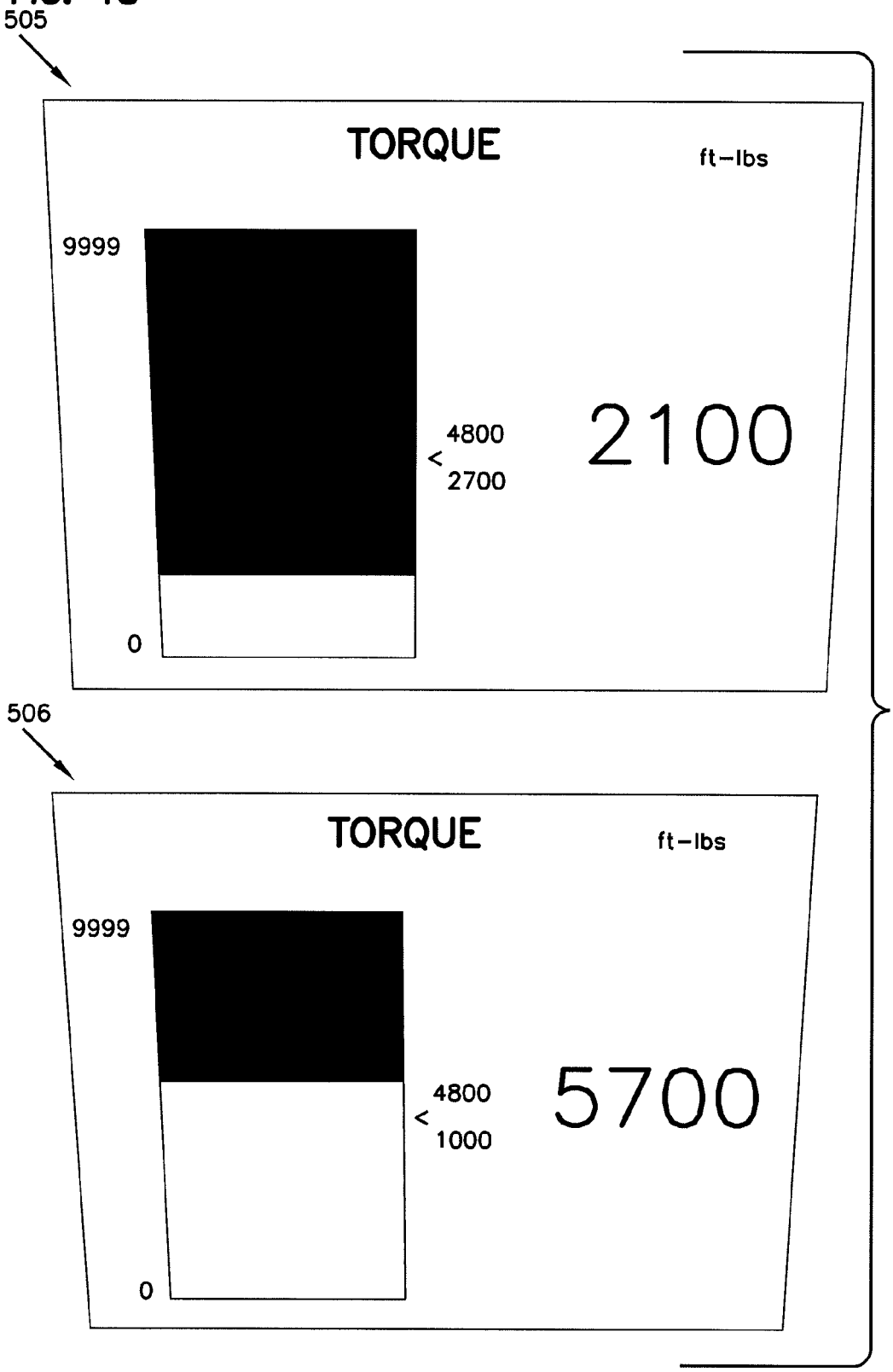
FIG. 15 shows optional screen views for displaying information for a power tong torque output shown in various states of operation.

FIGS. 12-13 show optional screen views 500-506 for displaying information for pad type load cells and a power tong torque output in various states of operation. Screen view 500 shows a pad type indicator screen wherein the first load cell has a load 21,000 pounds and second first load cell has a load of 10,000 pounds and wherein the total combined load is 31,000 pounds. Screen view 500 also shows that the user interface has been configured for 8" Totco™ brand load cells. Screen view 500 also shows a combined bar chart for the individual load cells which displays that the first load cell is more loaded than the second load cell. Also shown on screen view 500 is a torque load output of 2,200 ft-lbs. Screen views 501 and 502 are the same as screen view 500, but with other load values which show the total load in a near alarm condition. Screen views 503 and 504 on FIG. 14 show a deadline type display wherein the load is in a near alarm condition. Screen views 503 and 504 also display a measured torque value and a trend log graph of load data. FIG. 15 includes screen views 505 and 506 which show the display in the torque screen view. Screen view 505 shows the torque value numerically and graphically in a normal operating state while screen view 506 shows data which produces an alarm condition.

Figure 16:
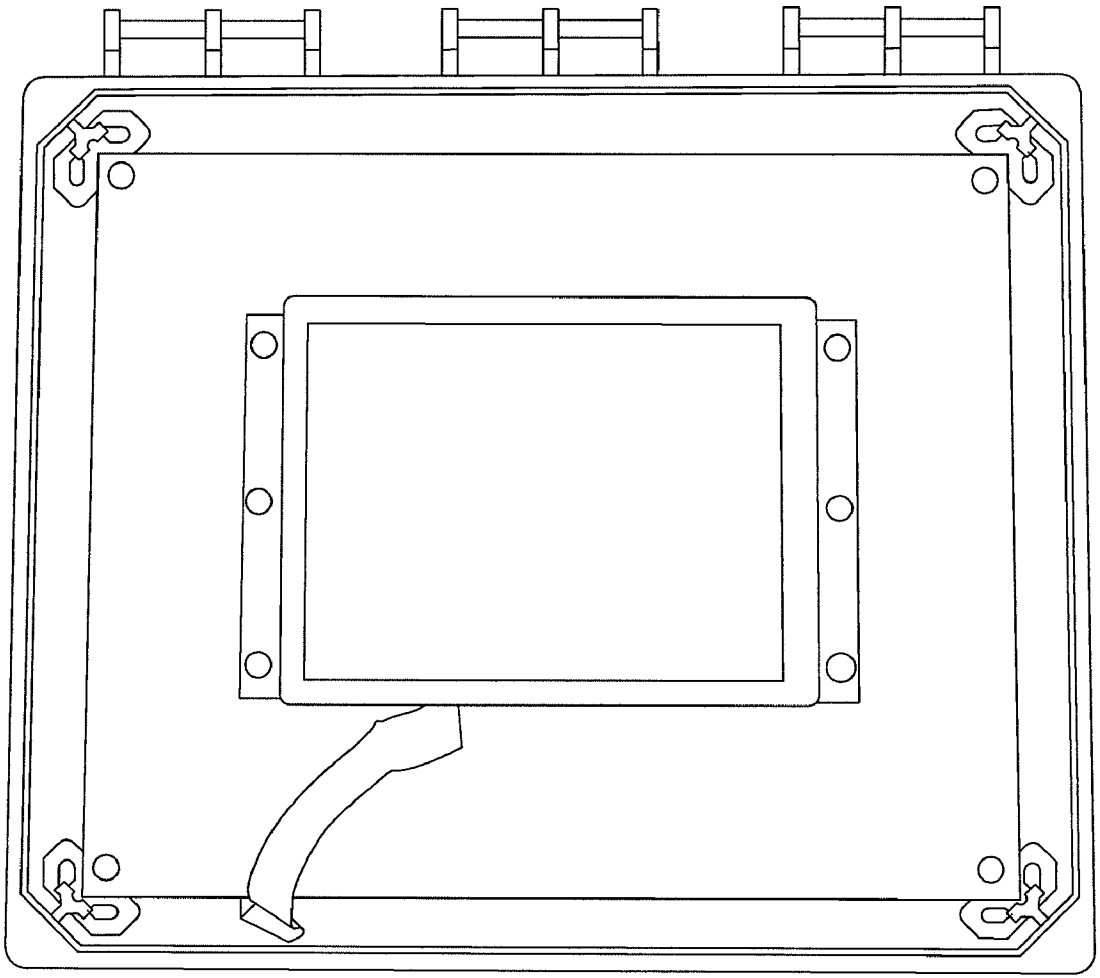
FIGS. 16-18 show a prototype version of the user interface module.
Figure 17:
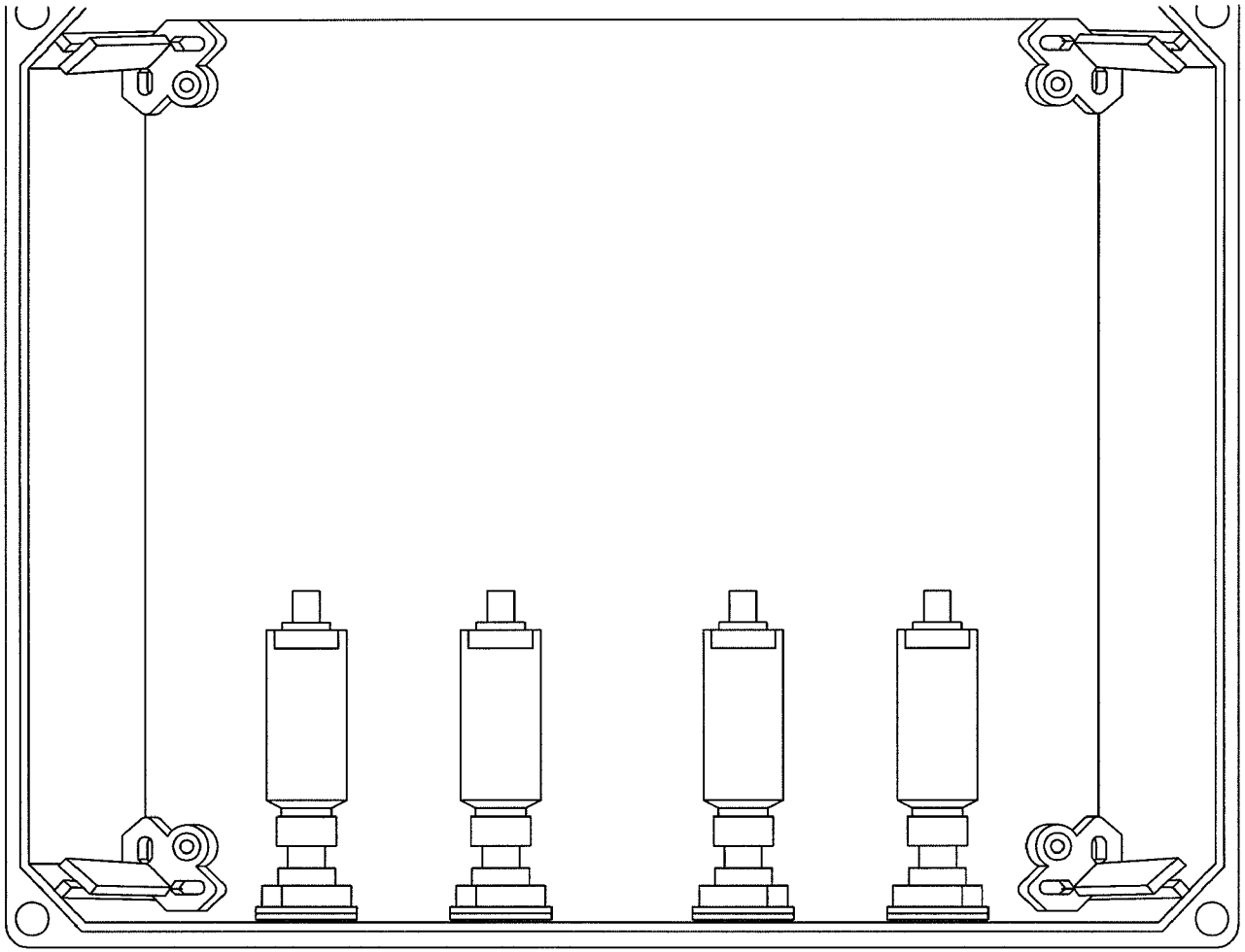
Figure 18:
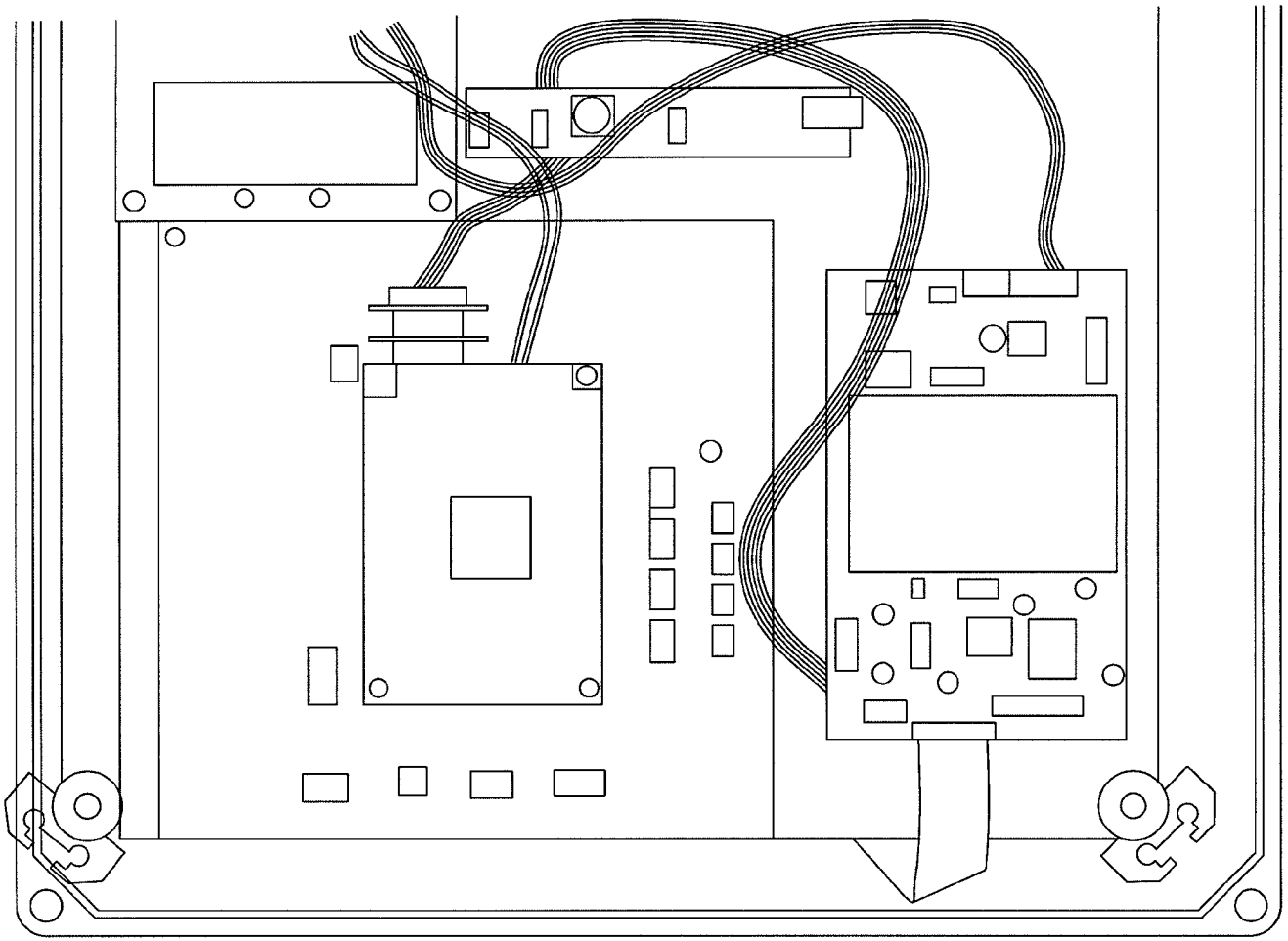

FIGS. 16-18 show a FIGS. 16-18 show a prototype version of the user interface module. FIG. 16 shows a user interface module with the front cover removed, but with the interface display screen visible and secured to a first mounting panel. FIG. 17 shows the user interface module with only four pressure transducers mounted within the bottom of the module. FIG. 18 shows a second mounting panel to which the wiring and electronics components of the invention are mounted. This mounting panel is located between the transducers and the first mounting panel for the display screen.

With regard to the foregoing description, it is to be understood that changes may be made in detail, especially in matters of the construction materials employed and the shape, size and arrangement of the parts without departing from the scope of the present invention. It is intended that the specification and depicted aspects be considered exemplary only, with a true scope and spirit of the invention being indicated by the broad meaning of the following claims.

I claim:

1. A system for monitoring well drilling and service operations comprising:

a first pressure transducer in fluid communication with a first pad type hydraulic load sensor;

a second pressure transducer in fluid communication with a second pad type hydraulic load sensor;

a third pressure transducer in fluid communication with a hydraulic diaphragm type deadline load sensor;

a digital user interface module in electronic communication with the first, second and third pressure transducers, wherein the digital user interface module functions to monitor the hydraulic pressures experienced at each pressure transducer and functions to calculate and display a corresponding weight load in numerical and graphical form for each pressure transducer.

2. The system for monitoring well drilling and service operations of claim 1, wherein the digital user interface module includes means for taring the calculated weight load to zero.

3. The system for monitoring well drilling and service operations of claim 1, further comprising a fourth transducer in fluid communication with a hydraulic power tong unit, wherein the digital user interface module also functions to monitor the hydraulic pressure experienced at the pressure transducer and functions to calculate and display a corresponding torque load produced by the power tongs in numerical and graphical form.

4. The system for monitoring well drilling and service operations of claim 3, wherein the digital user interface module is configured to provide alarm set points for each weight or torque load and to produce audible and visual alarms if the calculated load exceeds the alarm set point.

5. The system for monitoring well drilling and service operations of claim 3, wherein the digital user interface module is configured to store trend log data for each measured weight or torque load.

6. The system for monitoring well drilling and service operations of claim 3, wherein the system includes means for simultaneously using a diaphragm type weight indicator and/or a pad type weight indicator in conjunction with the digital user interface module.

7. The system for monitoring well drilling and service operations of claim 6, wherein the system includes a diaphragm type weight indicator having a load dial, the load dial being rotatable about a central pivot axis and configured to zero out a weight indication on the weight indicator.

* * * * *

UNITED STATES PATENT AND TRADEMARK OFFICE

CERTIFICATE OF CORRECTION

PATENT NO. : 8,286,727 B2
APPLICATION NO. : 12/797445
DATED : October 16, 2012
INVENTOR(S) : Don Darrell Hickman It is certified that error appears in the above-identified patent and that said Letters Patent is hereby corrected as shown below:

In the Specifications:

At column 6, line 26, "limit" should read "alarm limit".

Signed and Sealed this
Fourteenth Day of May, 2013

Teresa Stanek Rea
*Acting Director of the United States Patent and Trademark Office*